United States Patent [19]

Masada

[11] 4,213,845

[45] Jul. 22, 1980

[54] LUBE OIL BLEND PROCESS AND COMPOSITION

[75] Inventor: Gary M. Masada, Corte Madera, Calif.

[73] Assignee: Chevron Research Company, San Francisco, Calif.

[21] Appl. No.: 969,131

[22] Filed: Dec. 13, 1978

[51] Int. Cl.[2] ..... C10G 41/00

[52] U.S. Cl. ..... 208/19; 208/18; 208/311

[58] Field of Search ..... 208/19, 18, 311

[56] References Cited

U.S. PATENT DOCUMENTS

| | | | |
|---|---|---|---|
| 2,780,581 | 2/1957 | Macke et al. | 208/19 |
| 3,915,871 | 10/1975 | Bryer et al. | 208/19 |

*Primary Examiner*—Herbert Levine

*Attorney, Agent, or Firm*—D. A. Newell; D. L. Hagmann; M. K. Bosworth

[57] ABSTRACT

A lube oil blend process and composition are provided. In the process a raffinate lube oil stock having a superior sunlight stability is produced by contacting a gas oil with a suitable solvent under solvent-extracting conditions. The blend is produced by admixing raffinate and raw hydrocrackate lube oil stock. The blend contains, in parts by volume, for each 100 parts of the raffinate an amount of the hydrocrackate stock in the range from about 10 to 45 parts. The resulting blend exhibits a sunlight stability at least equivalent to that of the raffinate stock.

8 Claims, No Drawings

LUBE OIL BLEND PROCESS AND COMPOSITION

BACKGROUND OF THE INVENTION

This invention relates to an improved process for producing lube oil. More particularly, it relates to a process for producing a sunlight-stable lube oil blend in the absence of a hydrotreating or hydrogenation step.

Raw hydrocrackate lube oil stocks obtained by hydrocracking heavy oils are known for their poor sunlight stability. Consequently, common practice is to process the hydrocrackate, for example by a sequential hydrogenation, and thereby improve its stability. However, each additional step, especially a hydrogenation step in the production of a lube oil, adds to its already substantial cost.

In U.S. Pat. Nos. 3,530,061 (D. A. Orkin et at) and 3,852,207 (B. E. Stangeland et al) are disclosed combination hydrocracking and hydrogenation processes for the production of lube oils from heavy oils.

It is known in commercial practice to produce sunlight-stable lube oils by solvent-extracting a gas oil without employing a hydrogenation step (see, for example, Petroleum Processing Handbook, McGraw-Hill Book Company, William F. Bland and Robert L. Davidson, Co-editors, Sections 3–79 to 3–82, inclusive, and 3–86 to 3–92, inclusive, which are incorporated herein by reference). While such practice is advantageous, there is need for improvements, for example in terms of reduced cost and enhanced production capacity without a corresponding capital outlay for expanded facilities.

It is an object herein to provide an improved process for producing a sunlight-stable lube oil blend from gas oil lube oil stocks and raw hydrocrackate lube oil stocks.

A further object is to provide improvements, for example at reduced costs and with improved yield, in a lube blending process without including a hydrotreating or hydrogenation step in the process.

These and other objects will be clear from the description and examples to follow.

SUMMARY OF THE INVENTION

In accordance with the present invention, a process is provided for producing a lube oil blend from (1) a gas oil selected from the group consisting of atmospheric and vacuum gas oils having normal boiling point ranges in the range 260° C. to 565° C., and (2) a raw hydrocrackate lube oil (RHLO) stock, the process being carried out in the absence of a hydrotreating step, comprising:

producing a raffinate lube oil stock having, relative to the gas oil, a superior sunlight stability by contacting the gas oil with a suitable solvent under solvent-extracting conditions; and producing the blend by admixing the raffinate and RHLO stock, said blend (1) containing, in parts by volume, for each 100 parts of the raffinate an amount of the RHLO stock in the range of from about 10 to 45 parts, and (2) exhibiting a sunlight stability which is at least equivalent to that of the raffinate stock.

Surprisingly, raw hydrocrackate lube oil stock, which exhibits unsatisfactory sunlight stability, can be added in substantial amount to a raffinate obtained by solvent-extracting a gas oil, the raffinate exhibiting a satisfactory sunlight stability, without adverse effect upon the sunlight stability of the resulting blend. Further, and more surprising, the sunlight stability of the blend often materially exceeds that of the raffinate! A net effect of this discovery is that it permits up to about a 45% increase in lube oil production from a lube oil solvent-extraction process without any capital outlay for the solvent-extraction facility. Another advantage resides in the fact that there is, in general, a yield loss of lube stocks in a solvent-extraction step. This loss, of course, is not incurred in connection with the raw hydrocrackate fraction of the blend because it is not subjected to an extraction step.

EMBODIMENT

In a preferred embodiment of the invention an Arabian light vacuum gas oil having a normal boiling point range of 370° to 440° C. is used as feed to a solvent-extraction stage. This feed is extracted in a duo-sol-type countercurrent unit (see, for example, textbook entitled "Petroleum Processing", McGraw-Hill Book Company, 1959, pp. 262–268 and references cited therein) using propane and cresol solvents. The raffinate product, after solvent removal and steam stripping, is an excellent commercial grade lube oil having a sunlight stability of about 7 days. It is suitable for use as one major component of the lube oil blend composition of the invention.

The second major component of the blend herein is produced by catalytically hydrocracking an Arabian gas oil under the following conditions:

Temp., °C.: 405
Pressure, Atm. g.: 109
Space Velocity, V/V/Hr: 1.2
Hydrogen Rate, SCM/m$^3$: 1086

The resulting unhydrorefined (raw) hydrocrackate lube oil stock, typically, has a sunlight stability of only about 4 days and a viscosity index of about 104.

The catalyst employed for the hydrocracking is a catalyst composite of (1) an amorphous (silica-alumina gel matrix, (2) a hydrogenation component, preferably nickel and tungsten, (3) a stabilizing amount of a titanium component (calculated as $TiO_2$, about 7 weight percent), and (4) an ultra-stable HY-sieve component (see U.S. Pat. Nos. 3,536,605—J. R. Kittrell and 3,953,364—J. Jaffe).

The blend is produced by admixing a substantial amount of the raw hydrocrackate stock with the raffinate lube oil stock described above, for example, in a volume ratio of 30 volumes of the raw stock per 100 volumes of the raffinate. The resulting blend, typically, exhibits a sunlight stability of about ten days. This is a remarkable result in view of the sunlight stabilities of the individual components.

Sunlight Test

The purposes of this test is to subject a sample of an oil to sunlight and determine the time required to produce a noticeable precipitate. In general, oils which are unsatisfactory in terms of poor UV-stability form precipitates in less than about 7 days. The sample is placed in an ordinary clear glass vial and exposed to otherwise unfiltered sunlight. In order to provide for variations in sunlight intensity for different days, a side-by-side test of a known standard oil is made and the results are normalized to a predetermined standard, for example, the results achieved with the standard oil during a cloudless midsummer period of exposure. The test is simple yet effective and inexpensive relative to most physical test methods.

Feed to Extraction Stage

Feeds suitable for use herein for the production of the raffinate component of the lube oil blend of the invention are the atmospheric and vacuum gas oils ordinarily obtained from fractionating petroleum. They have normal boiling point ranges in the range of from about 260° to 565° C., preferably 340° to 565° C.

Representative feeds for the extraction stage include Arabian heavy or light gas oils, Alaskan North Slope heavy or light gas oils, solvent-deasphalted gas oils, and the like.

Solvent-Extraction Stage

The production of a UV-stable lube oil by solvent-extracting a gas oil of itself is not considered inventive herein, for such is known and practiced in the lube oil art and is contemplated for use herein. Briefly, in the extraction the oil is contacted with a suitable solvent in one or a series of steps. The contacting is carried out in any conventional liquid-liquid contacting apparatus (see, for example, Petroleum Processing Handbook, McGraw-Hill, 1967, Bland and Davidson, Co-editors) which provides for efficient contacting of the oil and solvent. Contact temperatures usually range from about −18° to 120° F., preferably 16° to 65°. In many cases atmospheric pressure is sufficient to maintain all of the components in the liquid phase; if not, a pressure at least sufficient to maintain this condition is applied. Where the oil is relatively heavy and viscous, it may be desirable to add a light hydrocarbon diluent, such as pentane.

A wide variety of suitable solvents is known and used, including dimethylformamide, dimethylsulfoxide, phenol, sulfuric acid, cresol, furfural, nitrobenzene, benzonitrile, N,N-dimethylformamide and the like, and are suitable for use herein. Double solvents (duo-sol), such as propane and a phenol-cresol mixture are especially useful herein, and preferred, because one selectively removes undesirable asphalt, polycyclic aromatic and color body impurities while the other preferentially removes non-cyclic materials and precipitates asphalt (see, for example, Petroleum Processing textbook referred to above).

Raw Hydrocrackate Component

The raw hydrocrackate required herein is obtained by catalytically hydrocracking under hydrocracking conditions a suitable hydrocarbon feed, for example, a petroleum refinery gas oil having a normal boiling point range in the range of from about 260° to 595° C. or a hydrocrackable heavy oil, for example a residuum, using a suitable catalyst, a composite including an amorphous cracking base or matrix, a hydrogenation component, and which optionally may, and preferably does, contain a crystalline zeolitic molecular sieve cracking component, for example of the zeolite Y- and ZSM-5-type, and the like, especially in their decationized and/or rare earth-exchanged forms. Hydrocracking conditions, catalysts and feeds, especially for lube oil stock production, are known in the art and of themselves are not considered inventive herein.

Representative hydrocracking catalysts and their components, including cracking bases, matrixes, hydrogenation components and the like, are described in the patent references listed below, especially in U.S. Pat. No. 3,790,472, which is referred to and incorporated herein by reference.

Representative of hydrocracking processes suitable for producing the raw hydrocrackate component are the processes described in the United States Patents listed below. Some of these references also include descriptions of the need for and steps taken to improve the UV-stability of raw hydrocrackate lube oil stocks: U.S. Pat. Nos. 3,308,055 (R. H. Kozlowski); 3,365,390 (C. J. Egan, et al); 3,463,724 (G. E. Langlois); 3,506,565 (R. J. White et al); 3,546,098; 3,617,482 (C. J. Egan); 3,781,196 (S. L. Thompson); 3,790,472 (R. J. White); and 3,852,207 (B. E. Stangeland).

Hydrocracking conditions, in general, include the following:

Temperature, °C.: 230–450
Pressure, Atm. g: 14–140
Space Velocity, V/V/Hr: 0.1–10
Hydrogen rate, SCM/m$^3$: 88–1760

The raw hydrocrackate component required herein may be the whole liquid component of the product from a hydrocracking stage. Preferably it is the bottoms fraction obtained by fractionally stripping the liquid component to remove a light oil fraction, for example, the 260° C.-, preferably the 345° C.-fraction thereof. Depending upon the particular lube oil blend desired, for example a light, medium or heavy lube oil blend, the raw hydrocrackate may be fractionally distilled into light, medium or heavy oil fractions.

EXAMPLES

The following examples are intended to provide further and representative illustration of the invention.

In these examples a commercial 125.7 N lube oil stock was used to prepare the blends tested. This stock was produced by solvent-extracting (see description in the embodiment described above) by the duo-sol method an Arabian light vacuum gas oil. Its viscosity index was 103. Blends were prepared and tested for sunlight stability by the sunlight test described above. The raw hydrocrackate components used and the normalized results are listed in the table below.

| Raw Hydrocrackate | DAYS TO FLOC IN SUNLIGHT TEST | | | | | | | |
|---|---|---|---|---|---|---|---|---|
| | Wt. % Raw Hydrocrackate | | | | | | | |
| | 0 | 10 | 20 | 30 | 50 | 80 | 90 | 100 |
| A[1] | 7 | 9 | 10 | 10 | 5 | 4 | 4 | 4 |
| B[2] | 7 | 10 | 10 | 6 | 6 | 4 | 3 | 5 |
| C[3] | 7 | 8 | 10 | 10 | 4 | 4 | 3 | 3 |
| D[4] | 7 | 7 | 7 | 7 | — | — | — | 3 |

(1)This hydrocrackate was obtained using a 370° to 538° C. cut of an Arabian light vacuum gas oil as feed to a hydrocracker containing a fixed-bed catalyst (see description in the embodiment above) and operating under process conditions including (1) a temperature of 404° C., (2) a pressure of 109 atm. g., (3) an LHSV of 1.2 and (4) a hydrogen rate of 1086 SCM/m$^3$. The raw oil had a viscosity index of 104, 158N.

(2)Same as in (1) except temperature was 399° C. The raw oil had a viscosity index of 103, 190N.

(3)Same as in (1) except that feed was a 288° to 460° C.cut, the temperature was 399° C., the pressure was 105atm. g., the LHSV was 2.3, and the hydrogen rate was810 SCM/m$^3$. The raw oil had a viscosity index of119, 88N.

(4)Same as (1) except the feed was a 393° to 538° C. cutof an Alaskan North Slope vacuum gas oil, the pressurewas 150 atm. g., the space velocity was 0.9 andthe hydrogen rate was 616 SCM/m$^3$. The raw oil had a viscosity index of 103, 210N.

These data demonstrate that certain blends of a sunlight-stable solvent-extracted lube oil stock with an unhydrorefined hydrocrackate oil which exhibits poor sunlight stability exhibit a sunlight stability which is at least equal and often superior to that of the stable lube oil stock. Thus, as much as about 10–45 weight percent of unstable unhydrorefined hydrocrackate may be added and the resulting blend will exhibit a satisfactory sunlight stability.

What is claimed is:

1. A process for producing a lube oil blend from (1) a gas oil selected from the group consisting of atmospheric and vacuum gas oils having normal boiling point ranges in the range 260° C. to 565° C., and (2) a raw hydrocrackate lube oil stock comprising:

producing a raffinate lube oil stock having, relative to said gas oil, a superior sunlight stability by contracting said gas oil with a suitable solvent under solvent-extracting conditions; and producing said blend by admixing said raffinate and raw stock, said blend (1) containing, in parts by volume, for each 100 parts of raffinate an amount of the raw stock in the range of from about 10 to 45 parts, and (2) exhibiting sunlight stability which is at least equivalent to that of said raffinate stock.

2. A process as in claim 1 wherein said blend exhibits sunlight stability superior to that of said raffinate.

3. A process as in claim 1 wherein said solvent is a double solvent.

4. A process as in claim 3 wherein said double solvent is propane and a phenol-cresol mixture.

5. A process as in claim 1 wherein (1) said raffinate is obtained by solvent-extracting an Arabian light vacuum gas oil having a normal boiling point range of about 370° to 440° C., (2) said raw hydrocrackate lube oil stock is obtained by hydrocracking an Arabian gas oil under conventional hydrocracking conditions, and (3) said blend contains about 30 volumes of said hydrocrackate per 100 volumes thereof.

6. The composition resulting from the process of claim 1.

7. The composition resulting from the process of claim 4.

8. The composition resulting from the process of claim 5.

* * * * *